US006223732B1

(12) United States Patent
Isobe et al.

(10) Patent No.: US 6,223,732 B1
(45) Date of Patent: May 1, 2001

(54) EVAPORATED FUEL TREATMENT APPARATUS FOR INTERNAL COMBUSTION ENGINE

(75) Inventors: Takashi Isobe; Takashi Yamaguchi, both of Saitama; Satoshi Kiso, Haga-gun, all of (JP)

(73) Assignee: Honda Giken Kogyo Kabushikikaisha, Tokyo (JP)

( * ) Notice: Subject to any disclaimer, the term of this patent is extended or adjusted under 35 U.S.C. 154(b) by 0 days.

(21) Appl. No.: 09/506,864

(22) Filed: Feb. 4, 2000

(30) Foreign Application Priority Data

Feb. 5, 1999 (JP) ..... 11-029264

(51) Int. Cl.[7] ..... F02M 33/04
(52) U.S. Cl. ..... 123/520
(58) Field of Search ..... 123/516, 518, 123/519, 520, 198 D; 73/119 A, 118.1

(56) References Cited

U.S. PATENT DOCUMENTS 5,327,873 * 7/1994 Ohuchi et al. ..... 123/520
5,443,051 * 8/1995 Otsuka ..... 123/520
5,501,199 * 3/1996 Yoneyama ..... 123/520
5,775,307 * 7/1998 Isobe et al. ..... 123/520
5,873,352 * 2/1999 Kidokora et al. ..... 123/520
5,878,727 * 3/1999 Huls ..... 123/520

FOREIGN PATENT DOCUMENTS 7-012016 1/1995 (JP) .
9-317572 12/1997 (JP) .

* cited by examiner

*Primary Examiner*—Thomas N. Moulis
(74) *Attorney, Agent, or Firm*—E. Russell Tarleton; Seed IP Law Group PLIC

(57) ABSTRACT

An evaporated fuel treatment apparatus that includes a fuel tank, a canister with an opening to the atmosphere, a charging passage that causes the fuel tank to communicate with the canister, a purging passage that causes the canister to communicate with the intake manifold of the internal combustion engine, a pressure adjustment valve installed in the charging passage, a bypass valve installed in a passage that bypasses the pressure adjustment valve, a purge control valve installed in the purging passage, a vent shut valve capable of opening and closing the opening port, an internal pressure sensor for detecting the internal pressure of the fuel tank, and a controller that opens the fuel tank to atmospheric pressure or opens the fuel tank to a negative pressure by controlling the bypass valve, purge control valve, and vent shut valve. The apparatus of the invention detects the presence or absence of leakage on the basis of the change in negative pressure that occurs after the fuel tank has been placed under a negative pressure.

15 Claims, 11 Drawing Sheets

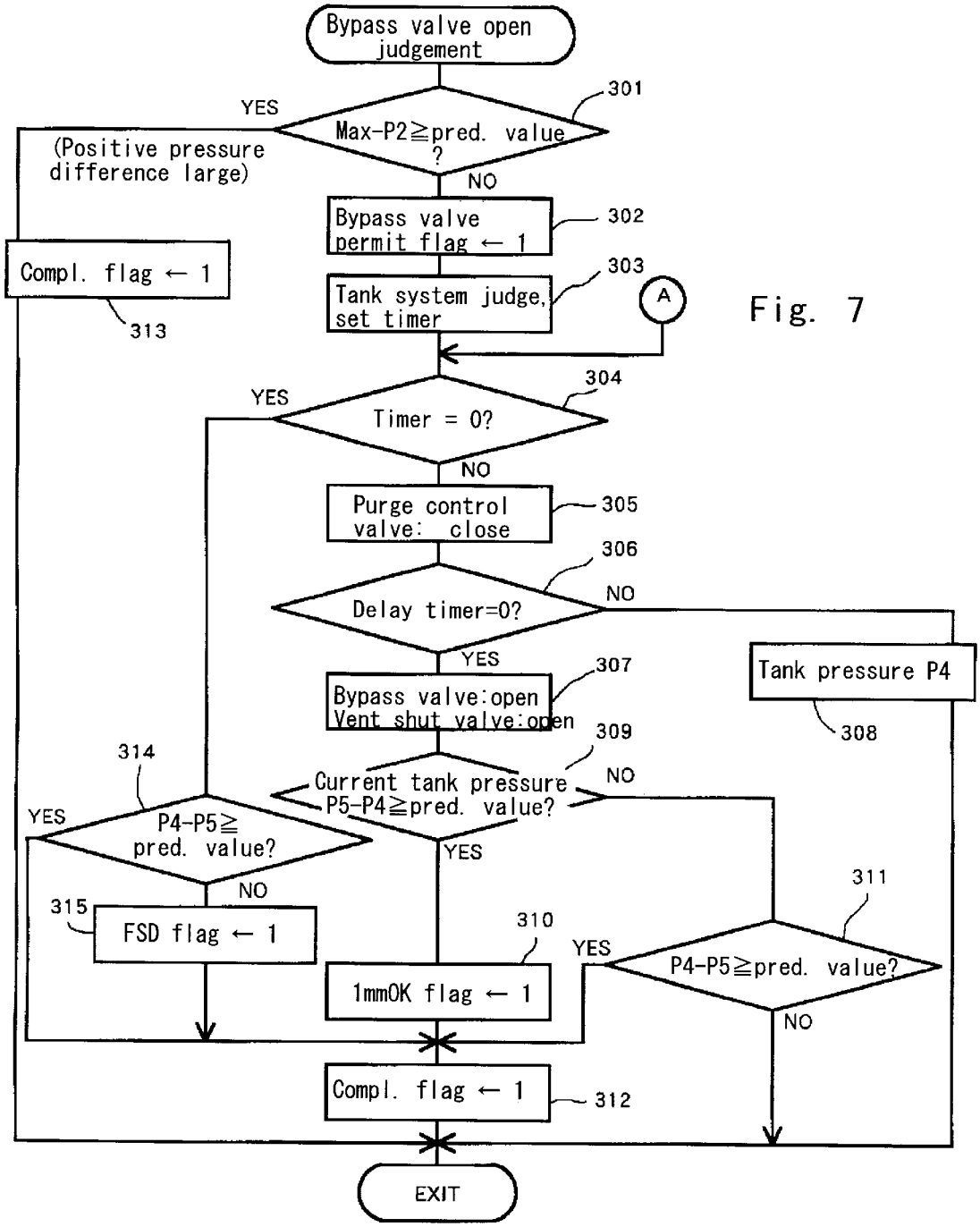
Bypass valve open judgement
301
Max-P2≧pred. value ?
YES
(Positive pressure difference large)
NO
Bypass valve permit flag ← 1
302
Compl. flag ← 1
313
Tank system judge, set timer
303
A
Fig. 7
304
Timer = 0?
YES
NO
Purge control valve: close
305
306
Delay timer=0?
NO
YES
Bypass valve:open Vent shut valve:open
307
Tank pressure P4
308
309
Current tank pressure P5-P4≧pred. value?
NO
YES
314
P4-P5≧ pred. value?
YES
NO
315
FSD flag ← 1
310
1mmOK flag ← 1
311
P4-P5≧pred. value?
YES
NO
Compl. flag ← 1
312
EXIT

EVAPORATED FUEL TREATMENT APPARATUS FOR INTERNAL COMBUSTION ENGINE

TECHNICAL FIELD

The present invention relates to an evaporated fuel treatment apparatus for an internal combustion engine that releases evaporated fuel generated inside the fuel tank into the intake manifold of the internal combustion engine. More specifically, the present invention concerns an evaporated fuel treatment apparatus for an internal combustion engine that facilitates determination of the presence or absence of leakage in an evaporated fuel discharge prevention system extending from the fuel tank to the engine intake system.

BACKGROUND OF THE INVENTION

A system for determining the presence or absence of leakage in a tank system is described in Japanese Patent Application Kokai No. Hei 7-83125. In this system, the pressure in an evaporated fuel discharge prevention system is lowered to a predetermined pressure. The target pressure reduction value of the pressure in the fuel tank is alternately set at an upper-limit value and a lower-limit value, and a feedback pressure reduction process is performed, which gradually causes the pressure in the fuel tank to converge on the target pressure reduction value. The amount of pressure shift in the fuel tank per unit time is calculated (leak down checking mode). In order to eliminate the effect of vapor on the judgment results, the amount of pressure shift per unit time caused by the evaporated fuel is calculated as a correction value. Determination of the presence or absence of leakage in the tank system is accomplished on the basis of a value obtained by subtracting, from the amount of pressure shift calculated in the above-mentioned leak down checking mode, a value produced by multiplying a coefficient by the amount of pressure shift obtained in the correction checking mode. If this value is equal to or less than a predetermined value, it is judged that the tank system is normal, with no leakage. On the other hand, if this value exceeds the predetermined value, it is judged that there is leakage in the tank system.

However, in cases where the leaking hole that is to be detected is a very small hole with a diameter of approximately 0.5 mm, a high degree of precision is required in the diagnostic results indicating the presence or absence of leakage. A disadvantage of the above-described approach is that errors may occur in the diagnostic results in cases where the tank pressure shifts in the negative pressure direction in the correction mode during tank pressure reduction monitoring or prior to tank pressure reduction monitoring.

SUMMARY OF THE INVENTION

The invention relates to an evaporated fuel treatment apparatus for an internal combustion engine having a fuel tank, a canister having an opening to the atmosphere, a passage allowing the fuel tank to communicate with the canister, a purging passage allowing the canister to communicate with the intake manifold of the engine, the intake manifold having a reduced pressure as the engine intakes air, and a pressure sensor for detecting the internal pressure of the fuel tank.

The apparatus includes a controller for controlling opening of the fuel tank to the atmosphere and alternately to a negative pressure, said controller detecting the presence or absence of leakage on the basis of the change in negative pressure that occurs after the fuel tank has been placed under a negative pressure, wherein said controller prohibits the detection of the presence or absence of the leakage in response to a change in the internal pressure of the fuel tank in the direction of negative pressure when a bypass valve is closed.

The apparatus of the invention detects the presence or absence of leakage on the basis of the change in negative pressure that occurs after the fuel tank has been placed under a negative pressure. In the present invention, detection of the presence or absence of leakage is prohibited in cases where the internal pressure of the fuel tank varies in the negative pressure direction when the bypass valve is closed. Accordingly, erroneous detection results can be avoided, and the precision of detection can be improved.

BRIEF DESCRIPTION OF THE DRAWINGS

FIG. 7 is a flow chart illustrating the bypass-valve-open judgment process.

DETAILED DESCRIPTION OF THE INVENTION

Figure 1:
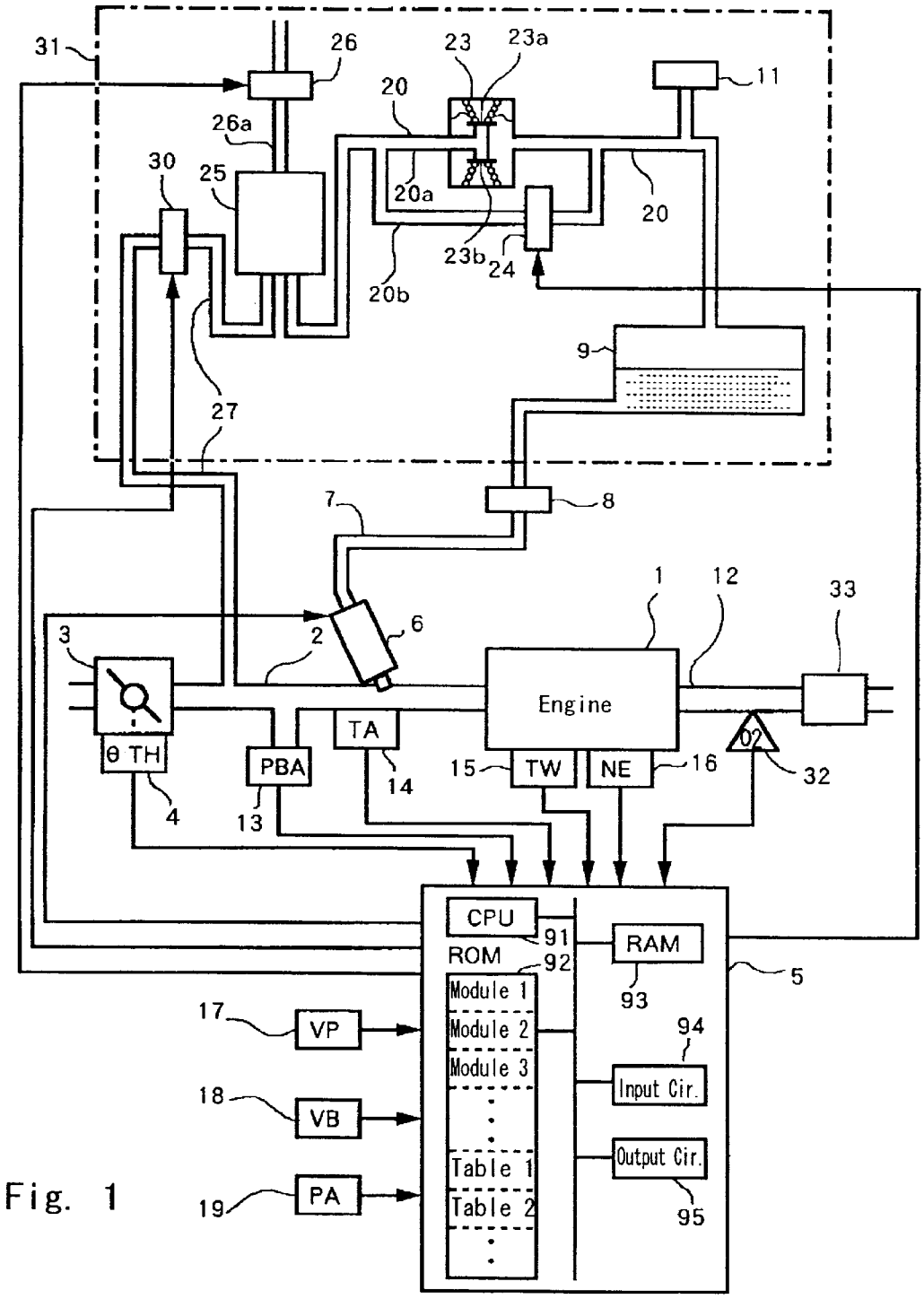
FIG. 1 is a diagram illustrating the evaporated fuel treatment apparatus of the present invention.

The disclosed embodiments of the present invention will be described with reference to the attached figures. FIG. 1 is an overall structural diagram of an evaporated fuel treatment apparatus for an internal combustion engine constructed according to a preferred embodiment of the present invention. This apparatus includes an internal combustion engine (hereafter referred to as the "engine") 1, an evaporated fuel discharge prevention device 31 and an electronic control unit (hereafter referred to as the "ECU") 5.

The ECU 5 constitutes a controller and includes a CPU 91, which performs operations in order to control various parts of the engine 1, a read-only memory (ROM) 92, which stores various types of data and programs that are used to control various parts of the engine, a random-access memory (RAM) 93, which provides a working region for operations by the CPU 91 and which temporarily stores data sent from various parts of the engine and control signals that are to be sent out to various parts of the engine, an input circuit 94, which receives data sent from various parts of the engine, and an output circuit 95, which sends out control signals to various parts of the engine.

In FIG. 1, the programs are indicated as module 1, module 2, module 3, etc. For example, the program that detects the presence or absence of leakage in the present invention is contained in modules 3, 4 and 5. Furthermore, the various types of data used in the above-mentioned operations are stored in the ROM 92 in the form of table 1, table 2, etc. The ROM 92 may be a re-writable ROM such as an EEPROM. In such a case, the results obtained from the operations of the ECU 5 in a given operating cycle are stored in the in the ROM and can be utilized in the next operating cycle. Furthermore, considerable quantities of flag information set in various processes can be recorded in the EEPROM, and utilized in trouble diagnosis.

For example, the engine 1 is an engine equipped with four cylinders, and an intake manifold 2 is connected to this engine. A throttle valve 3 is installed on the upstream side of the intake manifold 2, and a throttle valve opening sensor (θTH), 4 which is linked to the throttle valve 3, outputs an electrical signal that corresponds to the degree of opening of the throttle valve 3 sends this electrical signal to the ECU.

A fuel injection valve 6 is installed for each cylinder at an intermediate point in the intake manifold 2 between the engine 1 and the throttle valve 3. The opening time of these injection valves 6 is controlled by control signals from the ECU. A fuel supply line 7 connects the fuel injection valves 6 and the fuel tank 9, and a fuel pump 8 installed at an intermediate point in this fuel supply line 7 supplies fuel from the fuel tank 9 to the fuel injection valves 6. A regulator (not shown in the figures) is installed between the pump 8 and the respective fuel injection valves 6. This regulator acts to maintain the differential pressure between the pressure of the air taken in from the intake manifold 2 and the pressure of the fuel supplied via the fuel supply line 7 at a constant value. In cases where the pressure of the fuel is too high, the excess fuel is returned to the fuel tank 9 via a return line (not shown in the figures). Thus, the air taken in via the throttle valve 3 passes through the intake manifold 2. The air is then mixed with the fuel injected from the fuel injection valves 6 and is supplied to the cylinders of the engine 1.

An intake manifold pressure (PBA) sensor 13 and an intake air temperature (TA) sensor 14 are mounted in the intake manifold 2 on the downstream side of the throttle valve 3. These sensors convert the intake manifold pressure and intake air temperature into electrical signals and send these signals to the ECU 5.

An engine water temperature (TW) sensor 15 is attached to the cylinder peripheral wall (filled with cooling water) of the cylinder block of the engine 1. The sensor detects the temperature of the engine cooling water, converts this temperature into an electrical signal, and sends the result to the ECU 5. An engine rpm (NE) sensor 16 is attached to the periphery of the cam shaft or the periphery of the crank shaft of the engine 1. The sensor 16 outputs a signal pulse (TDC signal pulse) at a predetermined crank angle position with every 180-degree rotation of the crankshaft of the engine 1 and sends this signal to the ECU 5.

The engine 1 has an exhaust manifold 12, and exhaust gases are discharged via a ternary catalyst 33 constituting an exhaust gas cleansing device, which is installed at an intermediate point in the exhaust manifold 12. An O2 sensor 32 constitutes an exhaust gas concentration sensor; this sensor 32, which is mounted at an intermediate point in the exhaust manifold 12 detects the oxygen concentration in the exhaust gas and sends a signal corresponding to the detected value to the ECU 5.

A vehicle speed (VP) sensor 17, a battery voltage (VB) sensor 18 and an atmospheric pressure (PA) sensor 19 are connected to the ECU. These sensors respectively detect the running speed of the vehicle, the battery voltage, and the atmospheric pressure and send these values to the ECU 5.

The input signals from the various types of sensors are sent to the input circuit 94. The input circuit 94 shapes the input signal waveforms, corrects the voltage levels to predetermined levels, and converts analog signal values into digital signal values. The CPU 91 processes the resulting digital signals, performs operations in accordance with the programs stored in the ROM 92, and creates control signals that are sent out to actuators in various parts of the vehicle. These control signals are sent to the output circuit 95, and the output circuit 95 sends the control signals to actuators such as the fuel injection valves 6, bypass valve 24, vent shut valve 2, and purge control valve 30.

Next, the evaporated fuel discharge prevention system 31 will be described in conjunction with FIG. 1. The discharge prevention system 31 includes a fuel tank 9, a charging passage 20, a canister 25, a purging passage 27, and several control valves. The system 31 controls the discharge of evaporated fuel from the fuel tank 9. The discharge prevention system 32 can be conveniently viewed as being divided into two parts, with the bypass valve 24 in the charging passage 20 as the boundary between the two parts. The side including the fuel tank 9 is referred to as the tank system, while the side including the canister 25 is referred to as the canister system.

The fuel tank 9 is connected to the canister 25 via the charging passage 20, and the system is thus arranged so that evaporated fuel from the fuel tank 9 can move to the canister 25. The charging passage 20 has a first branch 20*a* and a second branch 20*b*, which are installed inside the engine space. An internal pressure sensor 11 is attached to the fuel tank side of the charging passage 20 for detecting the differential pressure between the internal pressure of the charging passage 20 and atmospheric pressure. In a normal state, the pressure inside the charging passage 20 is more or less equal to the pressure inside the fuel tank 9, and accordingly, the internal pressure detected by the internal pressure sensor 11 may be viewed as the pressure in the fuel tank 9 (hereafter referred to as the "tank pressure").

A two-way valve 23 is installed in the first branch 20*a*, which includes two mechanical valves 23*a* and 23*b*. The valve 23*a* is a positive-pressure valve that opens when the tank pressure reaches a value that is approximately 15 mmHg higher than atmospheric pressure. When this valve is in an open state, evaporated fuel flows to the canister 25 and is adsorbed in the canister. The valve 23*b* is a negative-pressure valve that opens when the tank pressure is approximately 10 mmHg to 15 mmHg lower than the pressure on the side of the canister 25. When this valve is in an open state, the evaporated fuel adsorbed in the canister 25 returns to the fuel tank 9.

A bypass valve 24, which is an electromagnetic valve, is installed in the second branch 20*b*. This bypass valve 24 is ordinarily in a closed state, and when leakage is detected in the discharge prevention system 31 of the present invention, the opening and closing action of this valve is controlled by control signals from the ECU 5.

The canister 25 contains active carbon that adsorbs the evaporated fuel, which has an air intake port (not shown in the figures) that communicates with the atmosphere via a passage 26*a*. A vent shut valve 26, which is an electromagnetic valve, is installed at an intermediate point in the passage 26*a*. This vent shut valve 26 is ordinarily in an open state, and when leakage is detected in the discharge prevention system 31 of the present invention, the opening and closing action of this valve is controlled by control signals from the ECU 5.

The canister 25 is connected to the intake manifold 2 on the downstream side of the throttle valve 3 via a purging passage 27. A purge control valve 30, which is an electromagnetic valve, is installed at an intermediate point in the purging passage 27. The fuel adsorbed in the canister 25 is appropriately purged into the intake system of the engine via this purge control valve 30. The on-off duty ratio of the purge control valve 30 is altered on the basis of control signals from the ECU 5, so that the flow rate is continuously controlled.

Figure 2:
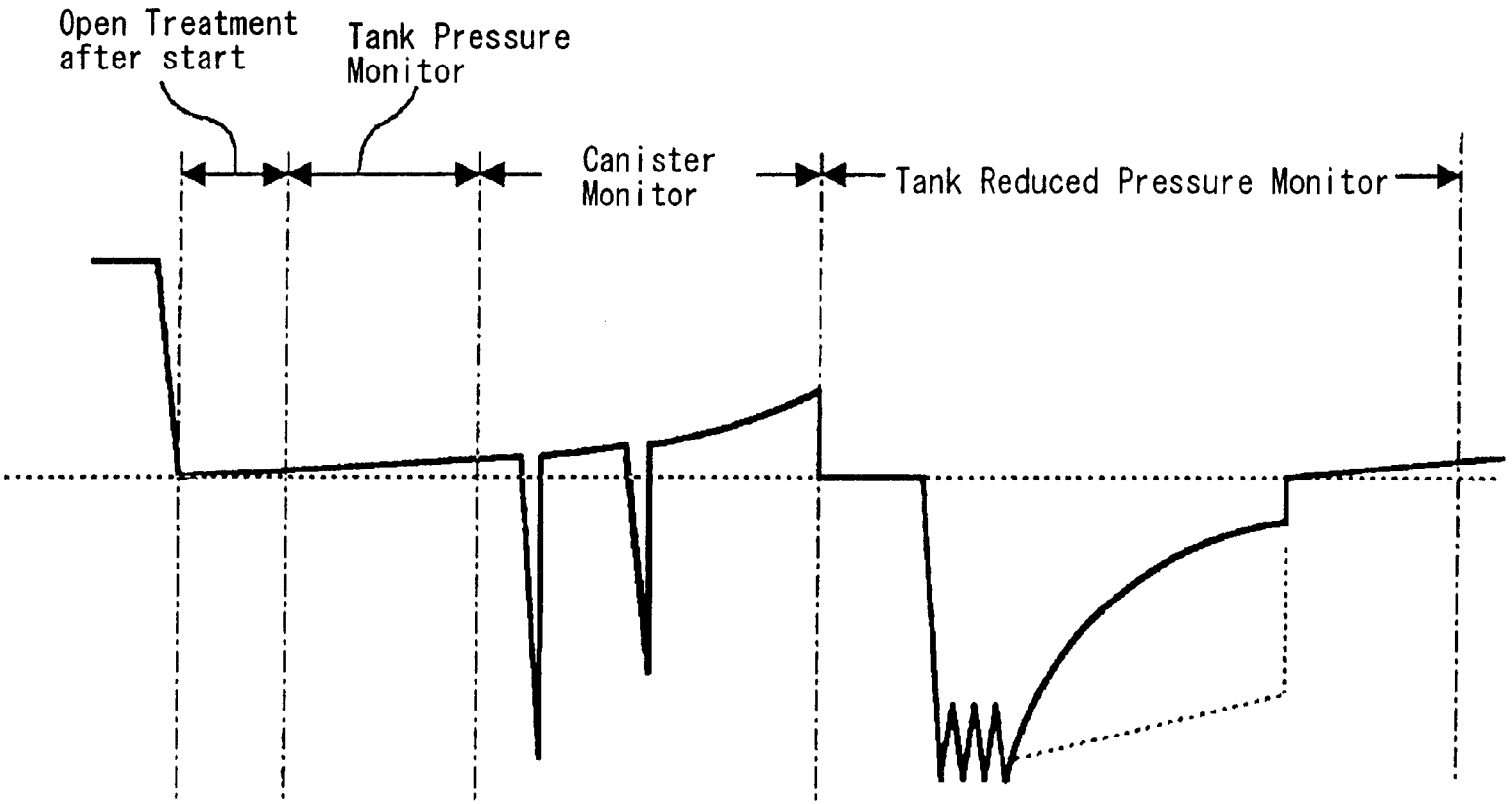
FIG. 2 is a functional block diagram of the ECU used in the present invention.

FIG. 2 shows an example of the transition of the pressure in the tank system during the determination of the presence or absence of leakage in one operating cycle of the engine from start to stop. The determination process for the presence or absence of leakage has four stages, i.e., an opening treatment performed after starting, monitoring of the tank pressure, monitoring of the canister, and monitoring of the tank pressure reduction. The monitoring of the tank pressure reduction will be described later with reference to FIG. 4. Here, an outline of the opening treatment performed after starting, the monitoring of the tank pressure and the monitoring of the canister will be described.

Opening Treatment Following Starting

In the opening treatment performed following starting, the bypass valve 24 is opened, so that the pressure of the discharge prevention system 31 is opened to atmospheric pressure. In this case, if the tank pressure shifts from the value measured prior to the opening of the system to the atmosphere by an amount equal to or greater than a predetermined value, it is judged that the tank system is normal, with no leakage.

Figure 5:
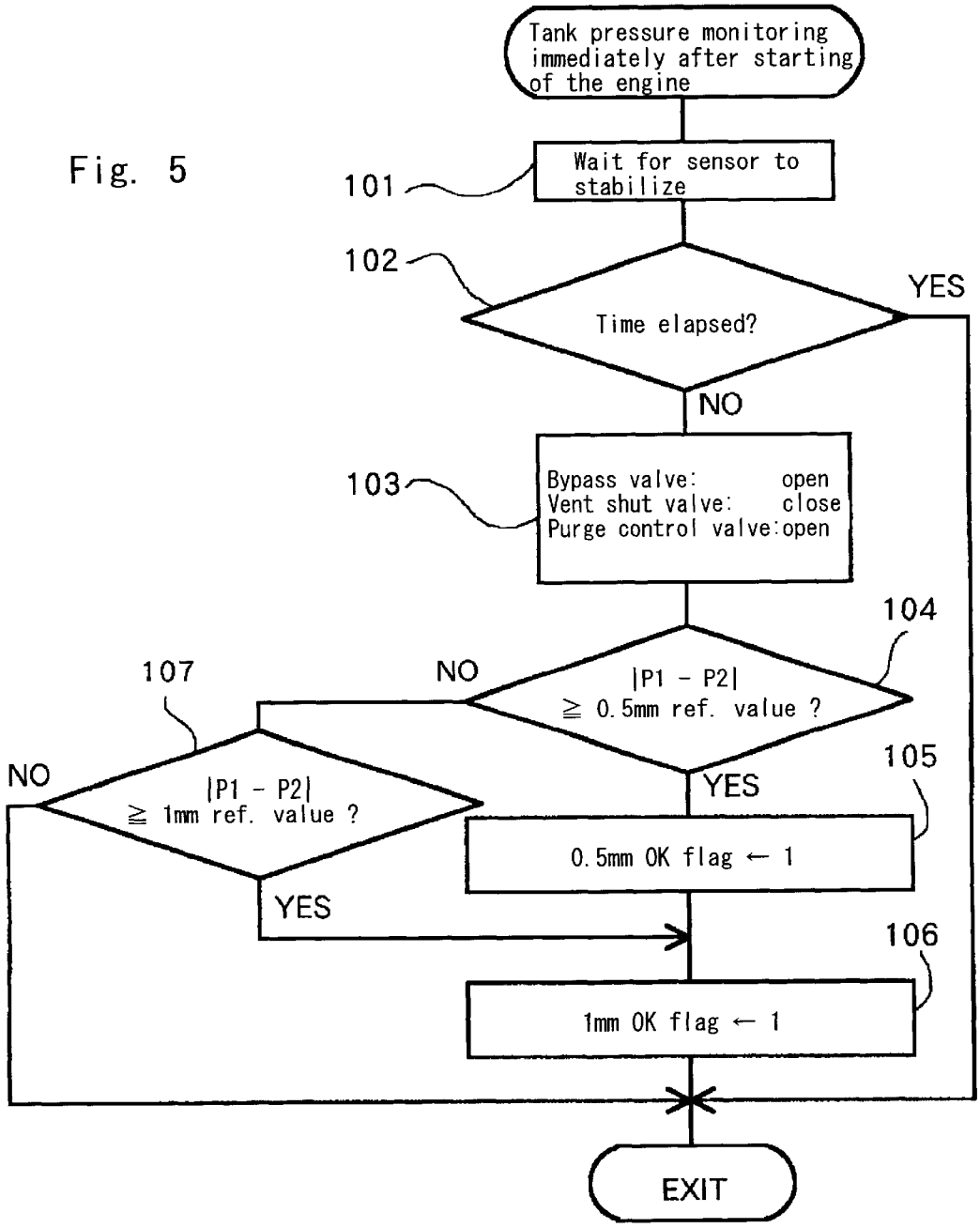
FIG. 5 is a flow chart illustrating tank pressure monitoring immediately following the starting of the engine.

The opening treatment following starting will be described with reference to the flow chart shown in FIG. 5. When the engine is started, the ECU 5 first detects the output of the internal pressure sensor 11 and stores this output in a RAM 93 (with which the ECU 5 is equipped) as the initial value P1 of the tank pressure. When the predetermined time required for the output of the internal pressure sensor 11 to stabilize has elapsed (101), a determination is made by means of a timer in step 102 as to whether or not the opening treatment time has elapsed. If the current time is still within the opening treatment time, the processing shifts to step 103. In this step, as a result of control signals being sent to the respective valves, the bypass valve 24 is opened, the vent shut valve 26 is opened, and the purge control valve 30 is closed, so that the fuel discharge prevention system 31 is opened to the atmosphere.

Next, in step 104, a determination is made as to whether or not the absolute value of the difference between the current value P2 of the internal pressure sensor and the initial value P1 of the tank pressure is equal to or greater than the first reference value, e.g., 4 mmHg, used to detect leakage caused by a hole with a diameter of 0.5 mm. Here, the initial value P1 of the tank pressure may be a positive pressure or a negative pressure depending on the conditions of use of the vehicle up to that point. Accordingly, the absolute value of P1–P2 is used for the determination involved. If the absolute value of the pressure difference is equal to or greater than the first reference value, then a determination is made that there is no leakage caused by a hole with a diameter of 0.5 mm or greater. In this case, the 0.5 mm OK flag is set at 1 (105), the 1 mm OK flag is set at 1, and the processing is ended.

In step 104, if the absolute value of P1–P2 is not equal to or greater than the first reference value, the processing shifts to step 107, and a determination is made as to whether or not the absolute value of P1–P2 is equal to or greater than the reference value (e.g., 2 mmHg) used to detect leakage caused by a hole with a diameter of 1 mm or greater. If the judgment is "yes", the 1 mm OK flag is set at 1 (106), and the processing is ended. In this case, the 0.5 mm OK flag is zero, and the 1 mm OK flag is 1. Accordingly, in the subsequent internal pressure monitoring process, monitoring for the 0.5 mm diameter criteria is performed. The value P2 of the tank pressure during the opening treatment is stored in the RAM 93 for use in the internal pressure monitoring process.

Internal Pressure Monitoring

Next, the internal pressure monitoring process will be described with reference to FIG. 6. The object of internal pressure monitoring is to make a continuous check of the output level of the internal pressure sensor 11, and to judge that leakage is present in cases where this level is concentrated in the vicinity of atmospheric pressure, and that no leakage is present in cases where this level shifts greatly toward a positive pressure or negative pressure.

Figure 6:
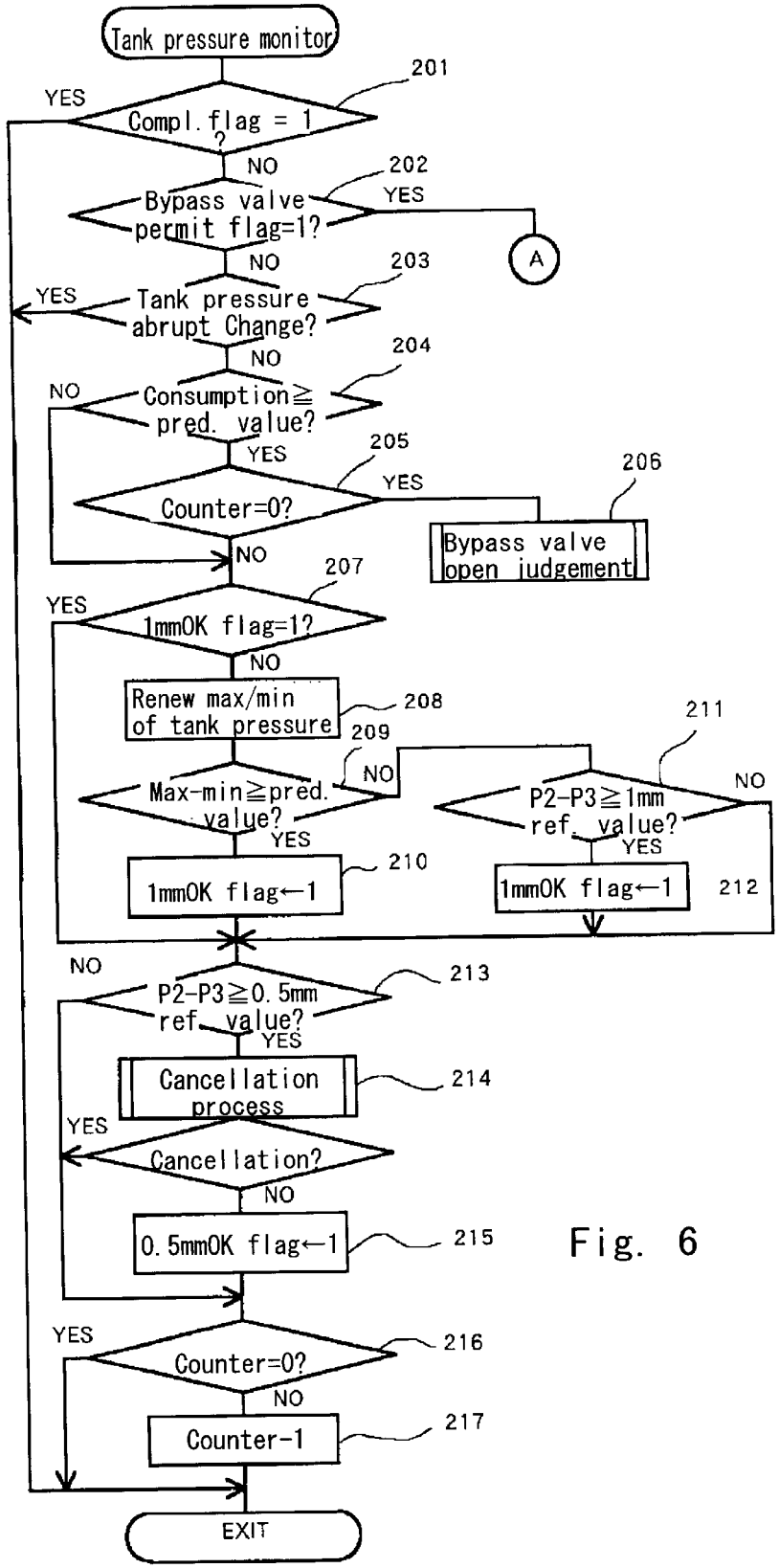
FIG. 6 is a flow chart illustrating internal pressure monitoring.

In cases where the completion flag, which is set at 1 when the series of internal pressure monitoring processes is completed, is not 1 (201), the process shown in FIG. 6 is initiated. In a state in which the bypass valve permission flag, which is set at 1 in processing that will be described later with reference to FIG. 7, is 1 (202), the processing proceeds to FIG. 7. In cases where this bypass valve permission flag is not 1, the processing proceeds to the process of step 203 and subsequent steps.

A judgment is made as to whether or not there has been an abrupt change in the tank pressure by making a comparison in order to ascertain whether or not the absolute value of the difference between the currently detected tank pressure and the tank pressure previously detected and stored in the RAM 93 is equal to or greater than a predetermined value (203). For example, an abrupt change in the tank pressure occurs when the fuel level oscillates as a result of abrupt starting of the vehicle into motion, etc., or when the fuel contacts the wall surfaces of the tank and is abruptly vaporized. Such conditions are not suitable for detecting vapor leakage. Accordingly, the processing is exited in such cases.

If it is judged that there has been no abrupt change in the tank pressure, the processing shifts to step 204, and a judgment is made as to whether or not the amount of fuel consumption is equal to or greater than a predetermined value. If the amount of fuel consumption is equal to or greater than this predetermined value, and the countdown timer is not at zero, then the processing proceeds to bypass-valve-open judgment processing that will be described later (206). This indicates a state in which the 1 mm OK flag is not set at 1, i.e., the 1 mm diameter criteria is not cleared, even though the processing from step 207 on in FIG. 6 has been performed a predetermined number of times.

The calculation of the amount of fuel consumption in step 204 uses values calculated in the background of the process. Specifically, in the background, the CPU 91 multiplies the sum of the valve opening time of the fuel injection valve 6 in a predetermined period by a predetermined coefficient, and thus converts this value into the amount of fuel consumption during this predetermined period. This value is stored in the RAM 93, and is rewritten at predetermined intervals.

In cases where the amount of fuel consumption is smaller than a predetermined value in step 204, or in cases where the counter value is not zero in step 205, i.e., in cases where the predetermined number of repetitions of monitoring has not been reached, the processing shifts to step 207, and a check is made in order to ascertain whether or not the 1 mm OK flag is 1. This 1 mm OK flag is set in cases where the 1 mm diameter criteria is cleared in the tank pressure monitoring performed immediately after starting in FIG. 4, or in step 210 or 212 described later.

If the 1 mm OK flag is not set at 1, the processing proceeds to step 208. Here, if the tank pressure currently indicated by the sensor 11 or the mean value obtained by sampling the output of the sensor 11 a predetermined number of times (in the present specification, the simple term "current tank pressure" may refer to a single measured value or the mean value of values sampled a plurality of times, depending on the nature of the processing) is greater than the maximum value of the tank pressure stored in the RAM 93 up to that time, the maximum value in the RAM 93 is rewritten as the current tank pressure, and if the current tank pressure is smaller than the minimum value of the tank pressure stored in the RAM 93 up to that time, the minimum value stored in the RAM 93 is rewritten as the current tank pressure.

If the difference between the maximum value and minimum value thus updated, i.e., the amplitude of the shift in the tank pressure, is equal to or greater than a predetermined value (209), it is judged that there is no leakage caused by a hole with a diameter of 1 mm or greater, and the 1 mm OK flag is set at 1 (210). Here, the predetermined value used in this judgment is a value read out from a map (using the engine water temperature (TW) at the time of starting as a parameter) stored in the ROM 92.

In cases where the amplitude of the shift in the tank pressure is smaller than the above-mentioned predetermined value, the processing shifts to step 211. Here, if the difference between the tank pressure P2 measured with the system open to the atmosphere and stored in the RAM 93 in the tank pressure monitoring immediately following starting described with reference to FIG. 5 and the current tank pressure P3 obtained from the internal pressure sensor 11 is equal to or greater than the reference value, e.g., 2 mmHg, used to detect leakage caused by a hole with a diameter of 1 mm or greater (211), it is judged that the tank system has the function of maintaining a negative pressure, and that there is no leakage according to the 1 mm diameter criteria. Accordingly, the 1 mm OK flag is set at 1 (212).

In cases where the 1 mm OK flag is set in step 207, cases where the 1 mm OK flag is set in step 210 or step 212, or cases where the value of P2−P3 is smaller than the 1 mm reference value in step 211, the processing shifts to step 213, and a judgment is made as to whether or not the value of P2−P3 is equal to or greater than the reference value for the 0.5 mm diameter criteria, e.g., 5 mmHg. If the value of P2−P3 is equal to or greater than this reference value, it is tentatively judged that the tank system has the function of maintaining a large negative pressure, and that there is no leakage according to the 0.5 mm criteria.

However, as will be described later in connection with the OK judgment cancellation processing, the tank pressure may assume a negative value as a result of special factors regardless of the presence or absence of leakage. Accordingly, the processing enters the cancellation processing subroutine of step 214, and a judgment is made as to whether or not such special factors are present. If it is judged in this subroutine that no special factors are present (that is, if it is decided not to cancel the judgment results of step 213), the 0.5 mm OK flag is set (215), and if the time counter has not reached zero (216), the process is exited after subtracting 1 from the time counter (217). If the time counter has reached zero, the process is exited "as is".

In the working example shown in FIG. 6, the program that executes the internal pressure monitoring process is invoked at predetermined time intervals, e.g., every 80 milliseconds, and this process is repeated until the time counter reaches zero (205). When the time counter reaches zero, the processing shifts to the bypass-valve-open judgment process (206) which is shown in detail in FIG. 7. In the bypass-valve-open process, the internal pressure monitoring completion flag is set in step 312 or 313. When this flag is set, the process in FIG. 5 detects this flag is step 201, and the processing is exited.

Bypass-Valve-Open Process

Next, the bypass-valve-open process will be described with reference to FIG. 7. This process is entered when the value of the time counter reaches zero in the process shown in FIG. 6 (205). Furthermore, this process is entered from step 304 in FIG. 7 in cases where it is detected that the bypass valve permission flag is set in the process shown in FIG. 6. A judgment is made as to whether or not the maximum value of the tank pressure updated in step 208 in FIG. 6 is greater (by a predetermined amount or more) than the tank pressure P2 measured with the system open to the atmosphere, which was detected in the post-starting tank pressure monitoring process shown in FIG. 5 and stored in the RAM 93 (301). If this maximum value of the tank pressure is greater than P2 by the above-mentioned predetermined value or more, this means that the tank system had the function of maintaining a positive pressure from the time of starting onward. Accordingly, the internal pressure monitoring completion flag is set (313), and the processing is ended.

The predetermined value used in the judgment performed in step 301 is a value which uses the engine water temperature (TW) at the time of starting as a parameter, and is stored in tabular form in the ROM of the ECU 5. In other words, in step 301, a predetermined value according to the engine water temperature is read out from the ROM, and a comparison is made in order to ascertain whether or not it (the maximum value of tank pressure−P2) is equal to or greater than this predetermined value.

In cases where the result of the comparison made in step 301 is "no", the permission flag for opening the bypass valve is set (302), and the predetermined time that is to be spent on the processing shown in FIG. 7 is set in the tank system judgment timer (303). Since the timer value thus set is not initially zero, the processing proceeds to step 305 via step 304, and the purge control valve 30 is closed. Step 306 is a step that waits for the closing of the purge control valve to stabilize. Since the delay timer has not reached zero at first, the process proceeds to step 308, and the current mean value of the tank pressure, which is calculated in the background, is stored in the RAM 93.

Like the processing routine shown in FIG. 6, the processing routine shown in FIG. 7 is also invoked at predetermined time intervals, e.g., every 80 milliseconds. Accordingly, after the process is exited via step 308, the processing again enters this process, and if the delay time is at zero, the ECU 5 sends control signals and opens the bypass valve and vent shut valve so that the tank system is opened to the atmosphere (307). In step 309, a judgment is made as to whether or not the current tank pressure P5 following the above-mentioned opening to the atmosphere has increased by a predetermined value or greater from the tank pressure P4 measured prior to the above-mentioned opening to the atmosphere. If the current tank pressure has increased by this predetermined value or greater, this indicates that the tank system had the function of maintaining a negative pressure. Accordingly, it is judged that there was no leakage caused by a hole with a diameter of 1 mm or greater. Consequently, the 1 mm OK flag is set (310), the internal pressure monitoring completion flag is set, and the process is exited (312).

In cases where the shift from negative pressure toward atmospheric pressure has not reached the above-mentioned predetermined value in step 309, the processing shifts to step 311, and a judgment is made as to whether or not P4−P5 is equal to or greater than a predetermined value, i.e., as to whether or not the tank pressure P5 following the above-mentioned opening to the atmosphere is smaller than the tank pressure P4 measured prior to the above-mentioned opening to the atmosphere by a predetermined value or greater (that is, whether or not the tank pressure showed a large shift toward atmospheric pressure from a positive pressure). The predetermined value used here may be different from the predetermined value used in step 309. Typically, a value read out from a table (using the water temperature (TW) at the time of engine starting as a parameter) stored in the ROM of the ECU 5 is used.

If the pressure shift is large, this means that the tank system had the function of maintaining pressure. However, a shift from a positive pressure is not suitable for detecting the presence or absence of leakage caused by very small holes. Accordingly, the completion flag is set (312) without setting the OK flag, and the process is exited. In cases where it is judged in step 311 that the shift in the pressure is not large, the judgment processing is repeated. Accordingly, the process is exited without setting the completion flag.

When the judgment process is repeated and the tank system judgment timer reaches zero (304), a judgment similar to that of step 311 is made in step 314. If the shift toward atmospheric pressure from a positive pressure is sufficiently large, the completion flag is set and the processing is ended. If the shift is not sufficiently large, the FSD flag is set (315), after which the completion flag is set and the processing is ended. The FSD flag is used along with numerous other flags in trouble diagnosis.

Thus, in one operating cycle (engine start to stop), after the above-mentioned series of internal pressure monitoring operations has been completed, there is no repetition of the same internal pressure monitoring. However, the frequency with which this is performed is a design matter, and may be altered as necessary.

Canister Monitoring

Figure 3:
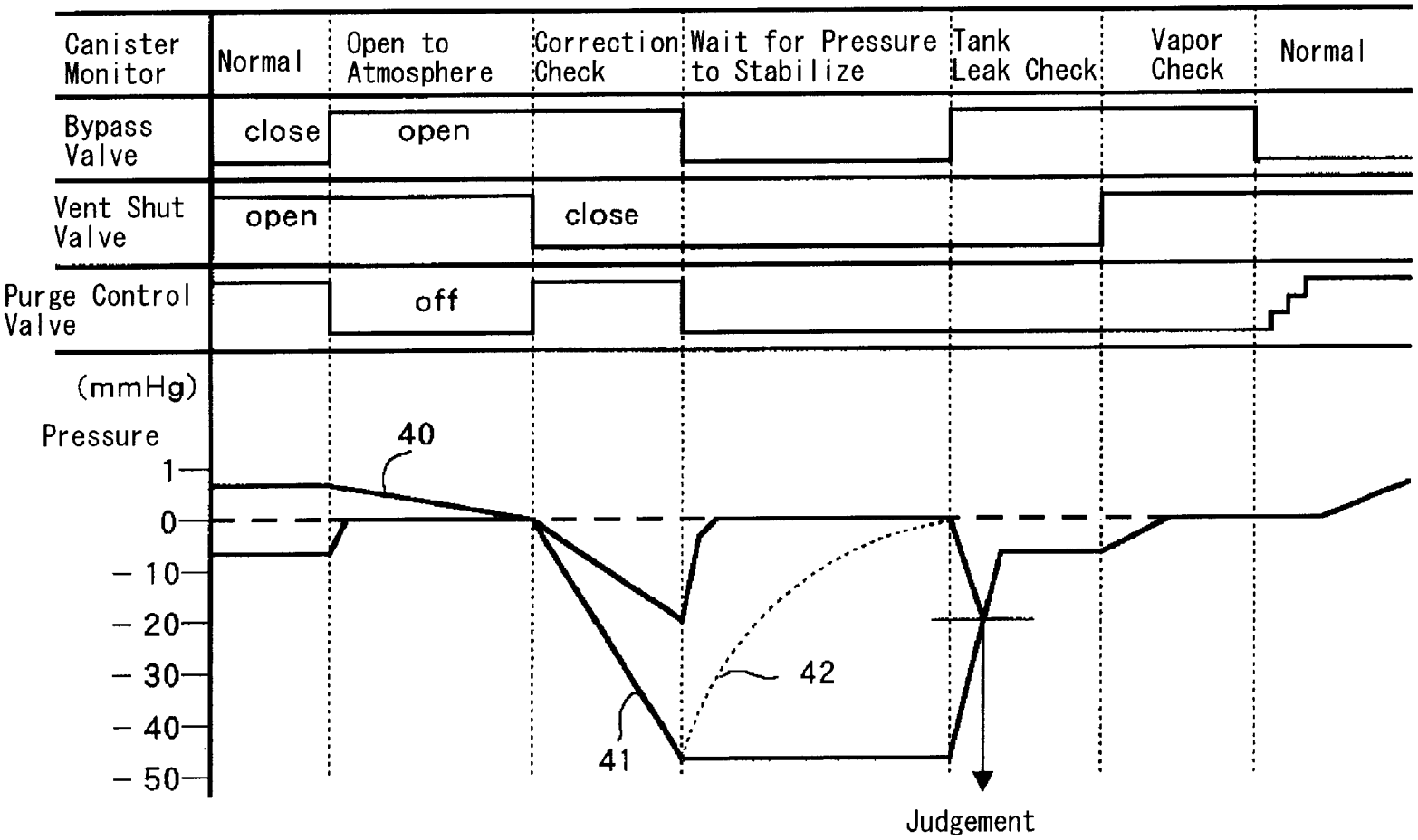
FIG. 3 shows a portion of the canister monitoring shown in FIG. 2, and illustrates the variation in the tank pressure and the actual internal pressure of the canister during the determination of the presence or absence of leakage in the canister system.

FIG. 3 illustrates in detail a portion of the canister monitoring shown in FIG. 2. Canister monitoring includes opening to the atmosphere, pressure reduction, waiting for internal pressure stabilization, leak checking and pressure recovery modes. The solid line 40 represents the value indicated by the internal pressure sensor 11. A judgment as to whether or not leakage has occurred in the canister 25 is made on the basis of this value. The solid line 41 indicates the change in the actual internal pressure of the canister in a case in which there is no leakage in the canister 25, and the solid line 42 indicates the change in the actual internal pressure of the canister in the internal pressure stabilization waiting mode in a case in which there is leakage in the canister 25.

The changes in pressure in the respective modes shown in FIG. 3 will be described. Initially, in the ordinary mode in which canister monitoring is not being performed, the bypass valve 24 is closed, and the vent shut valve 26 and purge control valve 30 are opened. The vapor from the fuel tank 9 temporarily accumulates in the canister 25 and is appropriately purged into the air intake system of the engine 1 via the purging passage 30.

In order to open the discharge prevention system 31 to the atmosphere when the process of judging the presence or absence of leakage in the canister is initiated, the processing shifts to the open-to-atmosphere mode with the bypass valve 24 open, the purge control valve 30 closed, and the vent shut valve 26 open. The reason that the discharge prevention system 31 is opened to the atmosphere is to accomplish a stable pressure reduction afterward. As is shown by the solid lines 40 and 41, the tank pressure and actual internal pressure of the canister change to atmospheric pressure. The time required for the open-to-atmosphere mode is (for example) 10 to 15 seconds.

When the output value of the internal pressure sensor 11 reaches atmospheric pressure in the open-to-atmosphere mode, the vent shut valve 26 is closed, the purge control valve 30 is opened, and the processing shifts to the reduced-pressure mode. As a result of the closing of the vent shut valve 26, the discharge prevention system 31 is cut off from the atmosphere. Furthermore, as a result of the opening of the purge control valve 30, the pressure in the canister is reduced to a predetermined pressure by utilizing the negative pressure of the engine. Here, this predetermined pressure is (for example) −40 to −60 mmHg. The internal pressure sensor 11 is attached to the charging passage 20, and indicates a value that reflects the negative pressure state of the canister system. However, since the capacity of the fuel tank 9 is extremely large, the fuel tank 9 is not reduced to the negative pressure indicated by the internal pressure sensor 11.

When the pressure has been reduced to the above-mentioned predetermined pressure, the bypass valve 24 and purge control valve 30 are closed, and the processing shifts to the mode of waiting for internal pressure stabilization. As a result of the bypass valve 24 being closed, the canister system and tank system are cut off from each other. Here, if there is no leakage in the canister 25, the actual internal pressure of the canister remains at a negative pressure as shown by the solid line 41. If there is leakage in the canister 25, the actual internal pressure of the canister recovers toward atmospheric pressure as shown by the dotted line 42. In the case of the above-mentioned 0.5 mm diameter, time is required for the recovery of the pressure from a negative pressure to a pressure in the vicinity of atmospheric pressure even if there is a hole in the canister. Accordingly, the time required for the mode of waiting for internal pressure stabilization is set at a longer time (e.g., 40 seconds) than in the case of the above-mentioned 1 mm diameter.

In the mode of waiting for internal pressure stabilization, the reason that the tank pressure recovers toward atmospheric pressure in a short time as shown by the solid line 40 is as follows. As was described above, since the fuel tank 9 is hardly placed under a negative pressure in the reduced-pressure mode, the sensor 11 detects the actual internal pressure of the fuel tank 9 without being affected by the negative pressure of the canister system when the bypass valve 24 is closed.

Next, the bypass valve 24 is opened, and the processing moves to the leak checking mode. If there is no leakage in the canister system, then the tank pressure shifts greatly toward a negative pressure from the pressure difference between the pressure of the canister system and the pressure of the tank system, since the canister system was maintained at a negative pressure. Accordingly, if the amount of shift is equal to or greater than the predetermined value, it is judged that the canister system is normal, with no leakage. If there is leakage in the canister system, the internal pressure of the canister and the internal pressure of the tank become more or less the same during the internal pressure stabilization waiting mode. Accordingly, the shift in the tank pressure is small. When such a state is detected, it is judged that there is leakage in the canister system, so that the canister system is judged to be abnormal. The time required for the leak checking mode is (for example) 3 seconds.

Next, the vent shut valve 26 is opened, and the processing shifts to the pressure recovery mode, so that the discharge prevention system 31 is returned to atmospheric pressure.

Tank Pressure Reduction Monitoring

Figure 4:
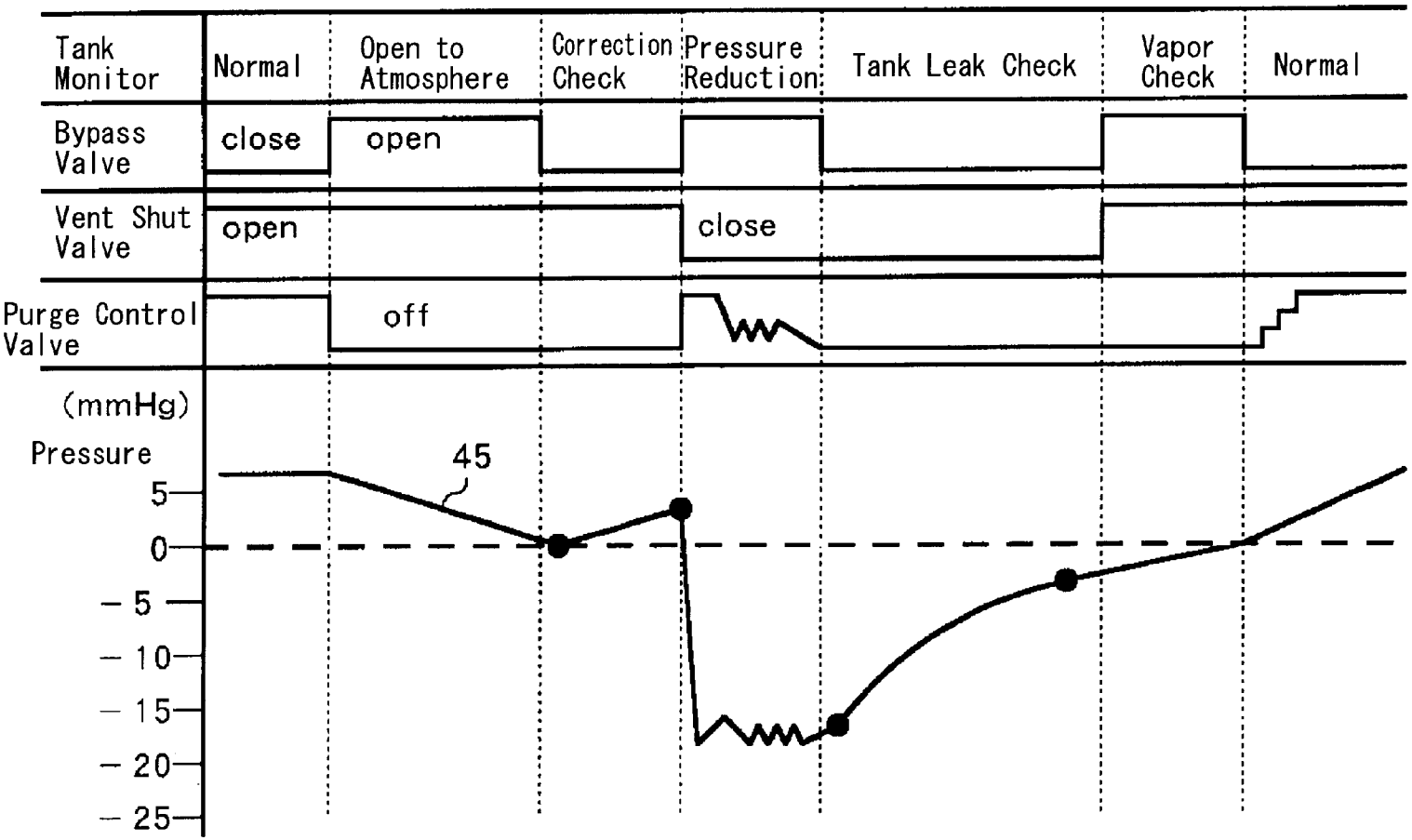
FIG. 4 is a graph showing changes in the tank pressure during the determination of leakage in the tank system in the tank pressure reduction monitoring portion in FIG. 2.

FIG. 4 is a diagram which shows in detail the tank pressure reduction monitoring portion of the diagram shown in FIG. 2. Tank pressure reduction monitoring is performed after the internal pressure monitoring. Leakage not detected in the opening treatment performed following starting or the internal pressure monitoring can be detected. For example, in cases where the system was judged to be normal (without leakage) only with respect to leakage caused by holes with a diameter of 1 mm or greater in the opening treatment performed following starting or the internal pressure monitoring, the presence or absence of leakage caused by holes with a diameter of 0.5 mm can be judged by performing this tank pressure reduction monitoring. Furthermore, if it is judged in the opening treatment performed following starting and the internal pressure monitoring that the system is normal (with no leakage) according to both the 1 mm diameter criteria and the 0.5 mm diameter criteria, it is also possible to dispense with this tank pressure reduction monitoring.

The above-mentioned tank pressure reduction monitoring includes opening to the atmosphere, correction checking, pressure reduction, tank leak checking and vapor checking (pressure recovery) modes. The solid line 45 indicates the pressure value indicated by the internal pressure sensor 11. Similar to the case of the canister monitoring, in the ordinary mode, only the bypass valve 24 is closed, and the vent shut valve 26 and purge control valve 30 are open.

When the tank pressure is at atmospheric pressure, the bypass valve 24 is closed, the vent shut valve 26 is opened, the purge control valve 30 is closed, and the processing shifts to the correction checking mode. Vapor is generated in the fuel tank 9, and the tank pressure rises depending on the amount of this vapor. Accordingly, this rise in pressure must be taken into account in the subsequent judgment of leakage in the tank system. In the correction checking mode, the amount of pressure shift per unit time involved in the rise from atmospheric pressure to a positive pressure is measured as a correction value. The time required for the correction checking mode is, for example, 30 seconds.

Next, the bypass valve 24 is opened, the vent shut valve 26 is closed, and the processing shifts to the pressure reduction mode. While the purge control valve is controlled, the tank pressure is stably reduced to a predetermined pressure, e.g., −15 mmHg. The internal pressure sensor 11 is installed in the narrow charging passage 20, which quickly shows a negative pressure. Since the volume of the fuel tank 9 is large in comparison, cases arise in which the pressure in the tank is not a negative pressure even though the sensor 11 indicates a negative pressure. Accordingly, in order to obtain a stable negative pressure state, feedback pressure reduction is performed following open pressure reduction.

As a result of this pressure reduction, the differential pressure between the pressure indicated by the internal pressure sensor 11 and the actual tank pressure becomes virtually zero. The time required for this pressure reduction mode is, for example, 30 to 40 seconds.

After the tank system has reached a predetermined negative pressure state, all of the valves 24, 26 and 30 are closed, and the processing shifts to the tank leak checking mode. If there is no leakage in the tank system, the negative pressure is more or less maintained, so that the amount of pressure that is restored (this is due to the effects of vapor) is small. If there is leakage in the tank system, as shown by the solid line 45, the amount of pressure that is restored is large. Since it is necessary to detect extremely small holes such as holes with a diameter of 0.5 mm, the time required for the tank leak checking mode is, for example, 30 seconds.

Next, the bypass valve 24 and vent shut valve 26 are opened, and the processing shifts to the vapor checking mode (pressure recovery mode), so that the tank system is returned to atmospheric pressure. Here, in cases where the tank pressure shifts toward atmospheric pressure from a positive pressure, this indicates that the tank pressure has fluctuated to a positive pressure as a result of vapor generation, etc., during the tank leak check, so that the accurate amount of pressure shift has not been calculated during the tank leak check. Accordingly, judgment of the presence or absence of leakage is prohibited. Conversely, as shown by the solid line 45 or by the broken line 46, in cases where the tank pressure shifts to atmospheric pressure from a negative pressure, the presence or absence of leakage in the tank system is judged on the basis of a value obtained by subtracting, from the amount of pressure shift per unit time during the leak check, a value produced by multiplying a coefficient to the amount of pressure shift per unit time during the correction check. The time required for the vapor checking mode is, for example, 3 seconds.

Judgment of Conditions for Tank Pressure Reduction Monitoring

When the diameter of the leaking hole that is to be detected is a very small hole diameter of approximately 0.5 mm, various driving conditions affect the judgment of the presence or absence of leakage. In order to improve the precision of detection, it is necessary to arrange the system so that judgment of the presence or absence of leakage is prohibited when factors that would lead to an erroneous judgment are present, and to detect the presence or absence of leakage in an operating state that produces highly reliable judgment results.

As one factor leading to such erroneous judgments, the inventor of the present invention discovered that conditions exist in which the tank pressure varies in the negative pressure direction prior to tank pressure reduction monitoring or during the correction mode. For example, such a variation in the tank pressure is observed when the fuel tank becomes wet during operation of the vehicle in rainy weather, so that the temperature drops.

Figure 8:
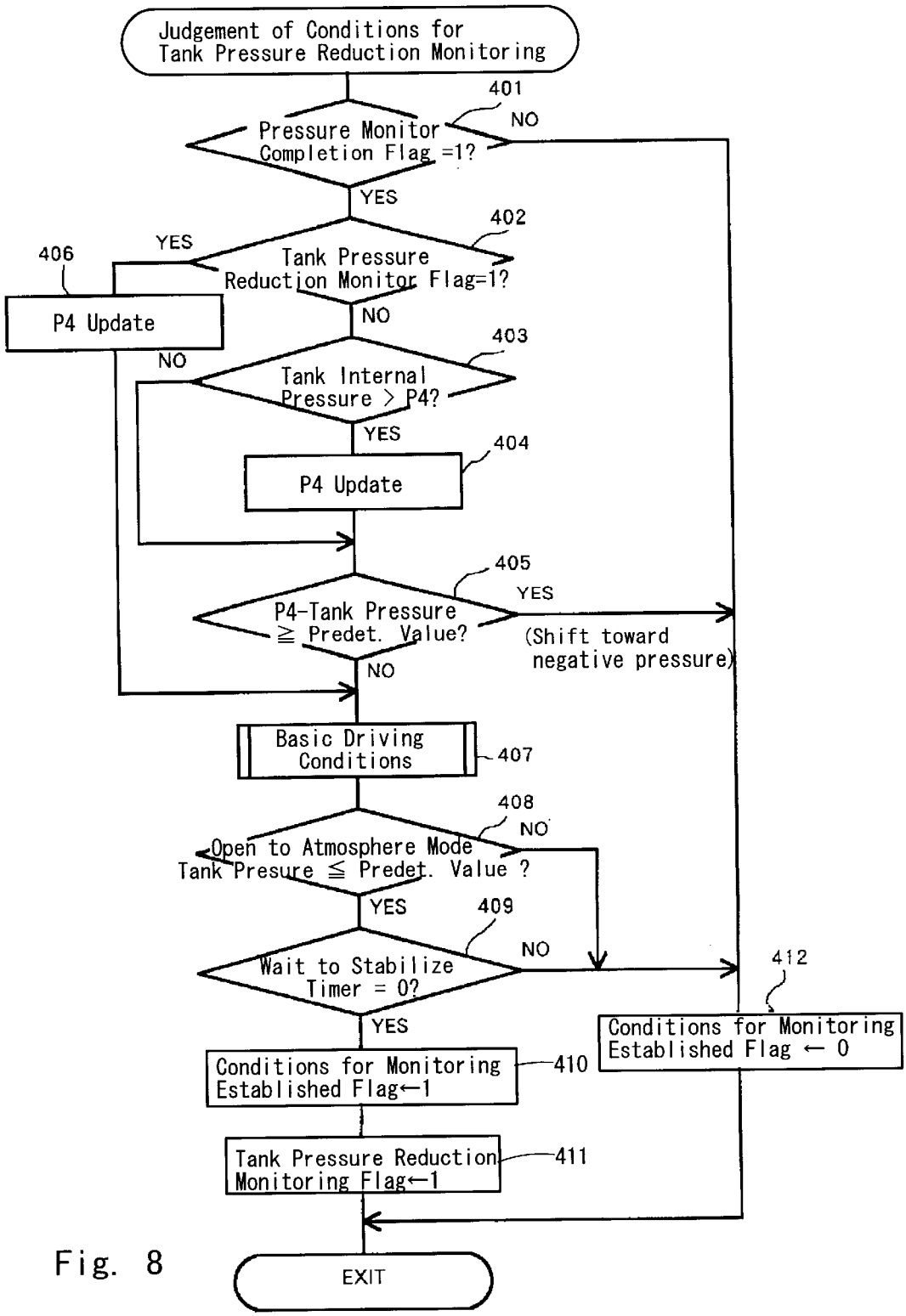
FIG. 8 is a flow chart illustrating the processing used to judge the presence or absence of suitable conditions for tank pressure reduction monitoring.

FIG. 8 is a flow chart which is used to illustrate the processing that prohibits the tank pressure reduction monitoring during the current operating cycle (engine start to stop) in cases where such factors are present. First, in step 401, a judgment is made as to whether or not the flag that indicates the completion of internal pressure monitoring is 1. If this flag is 1, i.e., if internal pressure monitoring has been completed, the processing proceeds to step 402. In cases where the internal pressure monitoring completion flag is not set, i.e., in cases where internal pressure monitoring has not been completed, a flag indicating the presence of suitable monitoring conditions is set at zero, and tank pressure reduction monitoring is prohibited (412).

In step 402, a judgment is made as to whether or not the tank pressure reduction monitoring flag is 1. Initially, this flag is not 1, and accordingly the processing proceeds to step 403, where a comparison is made in order to ascertain whether or not the current tank pressure is larger than the tank pressure P4 stored in the RAM 93. If the current tank pressure is larger than the tank pressure P4 stored in the RAM 93, the tank pressure P4 stored in the RAM 93 is updated to the current tank pressure.

In cases where the current tank pressure is not larger than P4, i.e., in cases where the current tank pressure is equal to or smaller than P4 (i.e., varying in the negative pressure direction from P4), the processing proceeds to step 405 without updating P4. Here, if the value of (P4–tank pressure) is equal to or greater than a predetermined value (e.g., 3 mmHg), i.e., if the tank pressure varies in the negative pressure direction from the tank pressure P4 stored in the RAM 93 by an amount equal to or greater than 3 mmHg, the flag indicating the presence of suitable monitoring conditions is set at zero in order to prohibit tank pressure reduction monitoring for the reasons described above (412).

In cases where the flag that permits tank pressure reduction monitoring is already 1, the processing skips steps 403 through 405, and after the value of P4 stored in the RAM 93 is updated to the current tank pressure (406), the processing enters a subroutine for judging the basic driving conditions in step 407. In this subroutine for judging the basic driving conditions, respective checks are made in order to ascertain whether or not the basic driving conditions of the vehicle are in a state suitable for tank pressure reduction monitoring, i.e., (i) whether or not the degree of throttle opening, engine rpm and vehicle speed are in respective predetermined ranges, (ii) whether or not the vehicle is in a high-load operating state that is unsuitable for reducing the pressure in the fuel tank, and (iii) whether or not the control of the air-fuel ratio is stretched to the limit, etc. If the results of these checks are judged to unsuitable for reduced-pressure monitoring, tank pressure reduction monitoring is not permitted. Since the above-mentioned checks and judgment processing are based on conventional technology, a detailed description is omitted here.

Next, a check is made in step 408 in order to ascertain whether or not the tank pressure in the open-to-atmosphere mode is equal to or less than a predetermined value in the vicinity of 1 mmHg. In cases where this condition is not satisfied, i.e., in cases where the tank pressure in the open-to-atmosphere mode is larger than the above-mentioned predetermined value, it is judged that the generation of vapor is especially great so that the conditions are not suitable for tank pressure reduction monitoring. Accordingly, the flag indicating the presence of suitable monitoring conditions is set at zero (412).

If the condition in step 408 is satisfied, the processing proceeds to step 409. In order to prevent frequent entering into and exiting from tank pressure reduction monitoring, the processing waits for a predetermined period of time to elapse (409). Then the flag indicating the presence of suitable monitoring conditions is set at 1 (410), the tank pressure reduction monitoring permission flag is set at 1 (411), and the process is exited. The processing shown in FIG. 8 is invoked at fixed time intervals, e.g., every 80 milliseconds.

Correction Checking Mode

Figure 9:
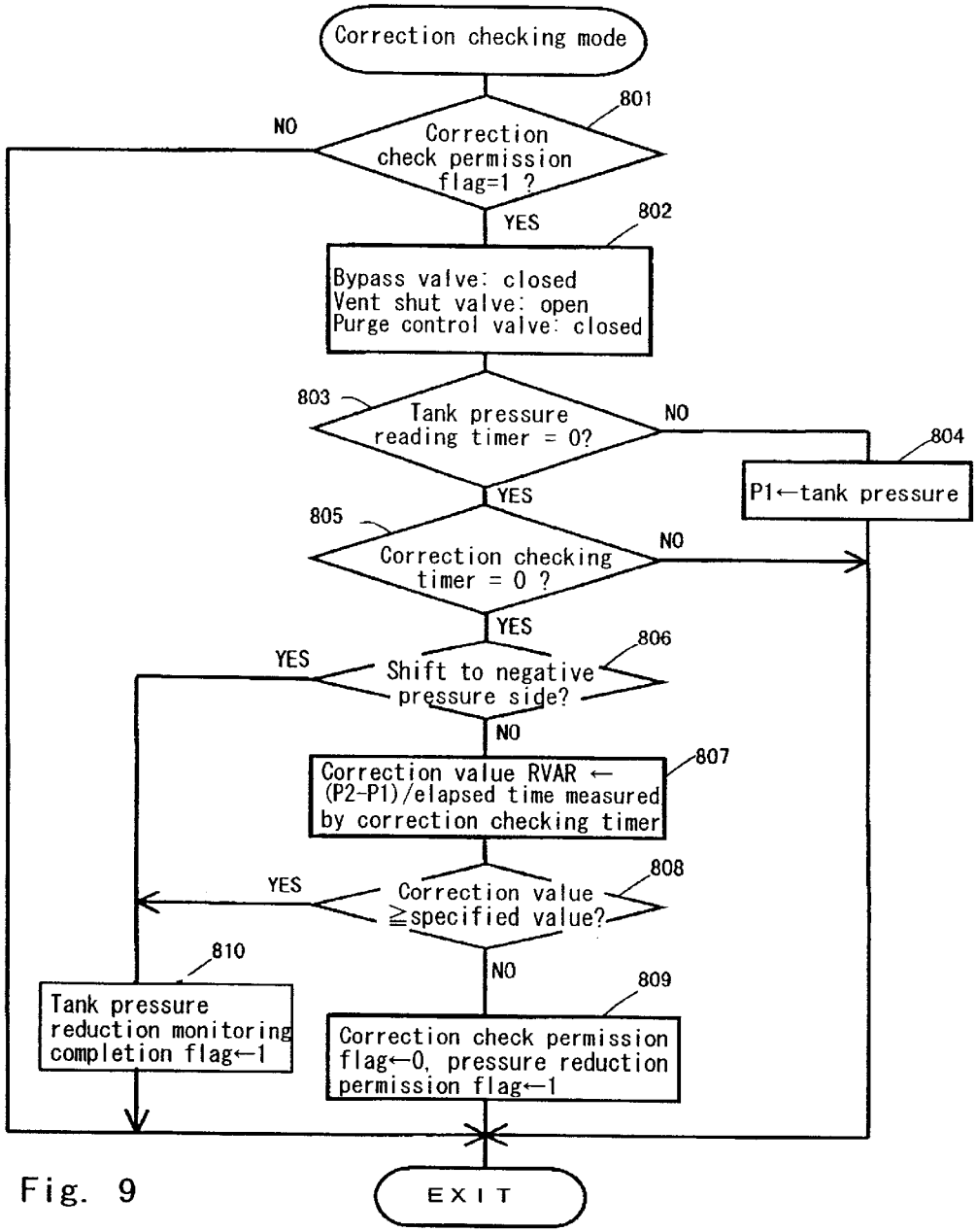
FIG. 9 is a flow chart illustrating the processing in the correction checking mode.

FIG. 9 is a flow chart showing the calculation of the correction value in the correction checking mode. If, in step 801, the correction check permission flag that is set upon the completion of the processing of the opening-to-atmosphere mode is 1, the processing advances to step 802, and the correction checking process is initiated. In step 802, the bypass valve 24 and purge control valve 30 are closed, and the vent shut valve 26 is opened.

The processing advances to step 803, and if the tank pressure reading timer is not at zero, the processing advances to step 804. Here, the output of the internal pressure sensor 11 is detected and is stored in the RAM 93 as the initial value PTR of the tank pressure is developed in this process. The reason for the installation of an tank pressure reading timer is to read the tank pressure when the pressure has become settled to some extent following the passage of a predetermined amount of time, since the tank pressure shifts when the bypass valve 24 is closed from an open state.

If the tank pressure reading time is at zero in step 803, i.e., if a predetermined amount of time has elapsed, the processing proceeds to step 805, and a judgment is made as to whether or not the correction checking mode timer is at zero. The correction checking mode timer is used in order to ascertain whether or not the time required for the calculation of the correction value has elapsed. This timer is set at a larger value than the above-mentioned tank pressure reading time. If the correction checking timer is at zero, the processing proceeds to step 806.

In step 806, the current tank pressure and the initial value PTR of the tank pressure stored in step 804 are compared, and a judgment is made as to whether or not the tank pressure has fluctuated toward the negative pressure side by a predetermined value, e.g., 3 mmHg, or greater. If the pressure shifts toward the negative pressure side, it indicates that the evaporated fuel is in a liquefied state as a result of a drop in the temperature inside the fuel tank, so that an appropriate correction value cannot be obtained. Accordingly, the processing proceeds to step 810, the tank pressure reduction monitoring completion flag is set at 1, and tank pressure reduction monitoring in this operating cycle is prohibited.

If there is no shift to the negative pressure side in step 806, the processing proceeds to step 807, and a correction value RVAR indicating the amount of shift in the tank pressure per unit time is calculated according to the equation shown below.

$$\text{Correction value } RVAR = (\text{internal tank pressure} - PTR)/\text{elapsed time measured by correction checking timer} \quad \text{(Formula 1)}$$

The processing proceeds to step 808. If the calculated correction value RVAR is equal to or greater than a predetermined value, there is a possibility that the tank pressure will adhere to the positive pressure side control pressure of the two-way valve 23 as a result of the generation of large amounts of vapor. The value calculated in such a state is not an appropriate correction value. Accordingly, the processing proceeds to step 810, the tank pressure reduction monitoring completion flag is set at 1, and tank pressure reduction monitoring is prohibited. If the correction value RVAR is smaller than the above-mentioned predetermined value, the processing proceeds to step 809, the correction permission flag is set at zero, and the pressure reduction permission flag is set at 1 in order to performed the next pressure reduction mode processing. The correction value RVAR thus obtained is stored in the RAM 93, and is used in the vapor checking mode.

Tank Leak Checking Mode

Figure 10:
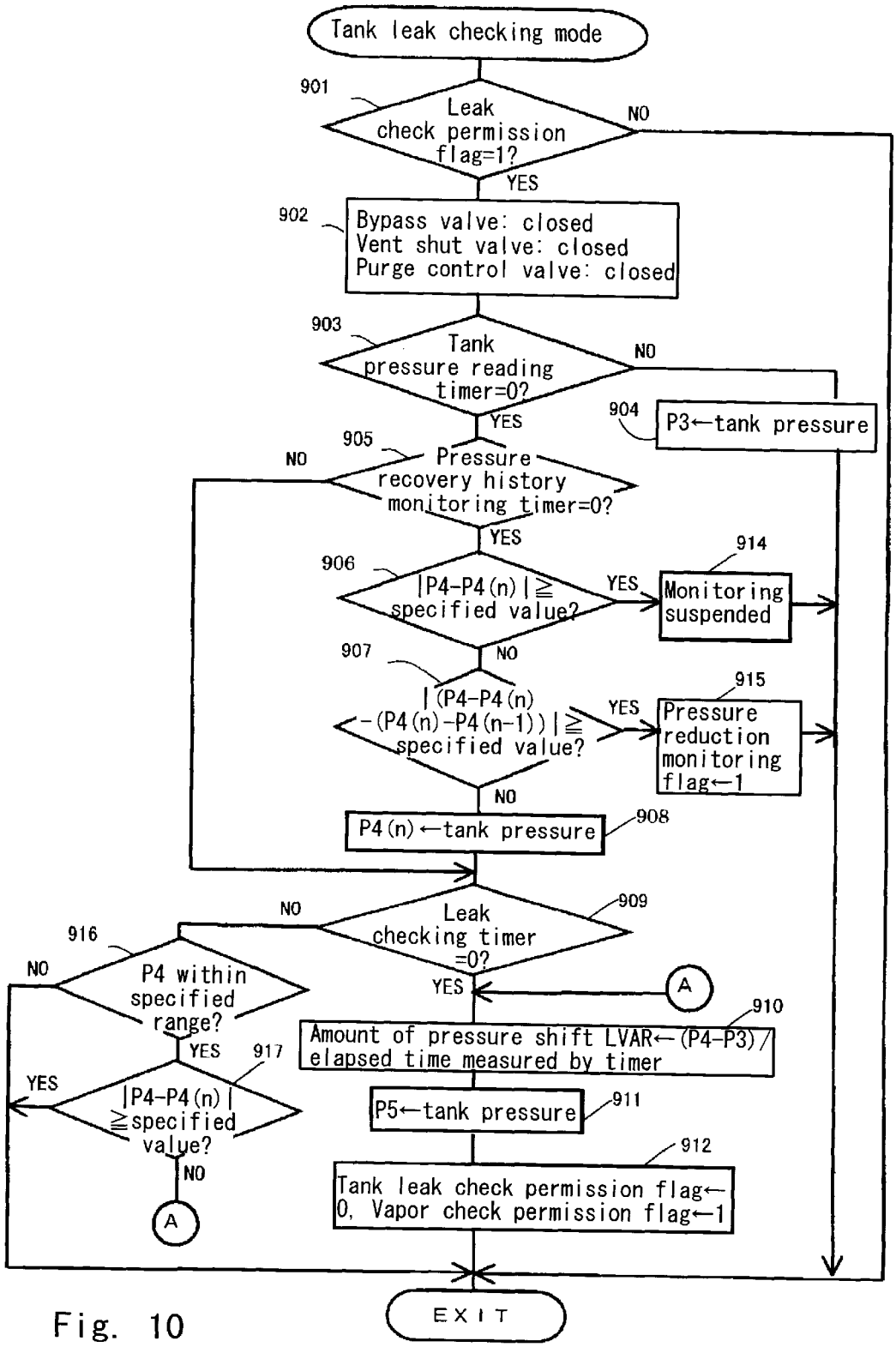
FIG. 10 is a flow chart illustrating the processing in the tank leak checking mode.

FIG. 10 is a flow chart showing the calculation of the amount of pressure shift per unit time when the interior of the fuel tank is placed under a negative pressure in the tank leak checking mode. This calculation is performed by the tank leak checking part 65 and associated pressure shift calculating part 72 shown in FIG. 2. If the tank leak check permission flag which is set at 1 by the pressure reduction mode part 63 (FIG. 2) upon the completion of the pressure reduction mode processing is 1 in step 901, the processing proceeds to step 902, and the tank leak checking process is initiated.

In step 902, the bypass valve 24, vent shut valve 26 and purge control valve 30 are all closed. The processing proceeds to step 903, and a judgment is made as to whether or not the tank pressure reading time is at zero. If the tank pressure reading timer is not at zero, the processing proceeds to step 904, and the value detected by the internal pressure sensor 11 is stored in the RAM 93 as the initial value P13 of the tank pressure. As in the case of the correction checking mode, the reason for the installation of the tank pressure reading timer is to read the tank pressure after the pressure has become settled to some extent following the passage of a predetermined amount of time.

It the tank pressure reading timer is at zero in step 903, the processing proceeds to step 905, and a judgment is made as to whether or not the pressure recovery history monitoring timer is at zero. If this timer is at zero, pressure recovery history monitoring (steps 906 to 908) is performed. This pressure recovery history monitoring is performed at predetermined time intervals during the processing of the tank leak checking mode and, each time, the tank pressure is read in step 908 and stored in the RAM 93 in a time series (i.e., this is stored with the previous tank pressure as P14(n) and the tank pressure before that as P14(n−1), etc.), so that the amount of pressure shift is monitored.

In step 906, if the absolute value of the difference between the current tank pressure P14 and the previous tank pressure P14(n) is equal to or greater than a predetermined value, this is judged to be an abrupt change in pressure caused by oscillation of the liquid level, etc., so that an appropriate amount of pressure shift cannot be calculated. Accordingly, tank pressure reduction monitoring is suspended, and the pressure is restored so that the processing returns to the ordinary mode. Here, the reason that the monitoring is suspended rather than being prohibited is that although there was an abrupt pressure shift in the current tank leak check, such a pressure variation may not occur in the next tank leak check.

The processing proceeds to step 907, and the difference P14−P14(n) between the current tank pressure P14 and the previous tank pressure P14(n) (this is designated as ΔPx), and the difference P14(n)−P14(n−1) between the previous tank pressure P14(n) and the tank pressure P14(n−1) preceding said previous tank pressure P14(n) (this is designated as ΔPy), are calculated. If the absolute value |ΔPx−ΔPy| of the difference between ΔPx and ΔPy is equal to or greater than a predetermined value, it is judged that the fuel tank is in full-tank cut-off valve operation. Since an appropriate amount of pressure shift cannot be calculated in such a state, the processing proceeds to step 915, the tank pressure reduction monitoring completion flag is set at 1, and tank pressure reduction monitoring for this operating cycle is prohibited.

After the above-mentioned pressure recovery history monitoring has been completed, the processing proceeds to step 909, and a judgment is made as to whether or not the tank leak checking timer is at zero. If this timer is at zero, the processing proceeds to step 910, and the amount of pressure shift per unit time (LVAR) in the tank leak checking mode is calculated according to the equation shown below on the basis of the current tank pressure P14 and the initial value P13 of the tank pressure stored in step 904. This calculated LVAR is stored in the RAM 93, and is used in the vapor checking mode.

Amount of pressure shift per unit time $LVAR=(P14-P13)$/elapsed time measured by tank leak checking timer. (Formula 2)

The processing proceeds to step 911, and the pressure value detected by the internal pressure sensor 11 is stored in the RAM 93 as the tank pressure P15 at the time of completion of the tank leak check. This value is used in the subsequent vapor checking mode. The processing proceeds to step 912, the tank leak check permission flag is set at zero, and the vapor check permission flag is set at 1 in order to perform the subsequent processing in the vapor checking mode.

If the tank leak checking timer is not at zero in step 909, the processing proceeds to step 916, and a judgment is made as to whether or not the current tank pressure P14 is within a predetermined range in the vicinity of atmospheric pressure. If the current tank pressure P14 is within this predetermined range, the processing proceeds to step 917, and a judgment is made as to whether or not the absolute value |P14−P14(n)| of the difference between the current tank pressure P14 and the previous tank pressure P14(n) is equal to or greater than a predetermined value. If the absolute value of said difference is smaller than this predetermined value, [this indicates that] the pressure has become more or less settled, so that there is no need to wait for the passage of time as measured by the tank leak checking timer. Accordingly, the processing proceeds to step 910, and the amount of pressure shift per unit time is calculated. The calculation in this case is performed using the following equation:

Amount of pressure shift per unit time $LVAR=(P14-P14(n)$/time from the starting of the tank leak checking timer to the judgment made in step 917. (Formula 3)

Vapor Checking Mode

Figure 11:
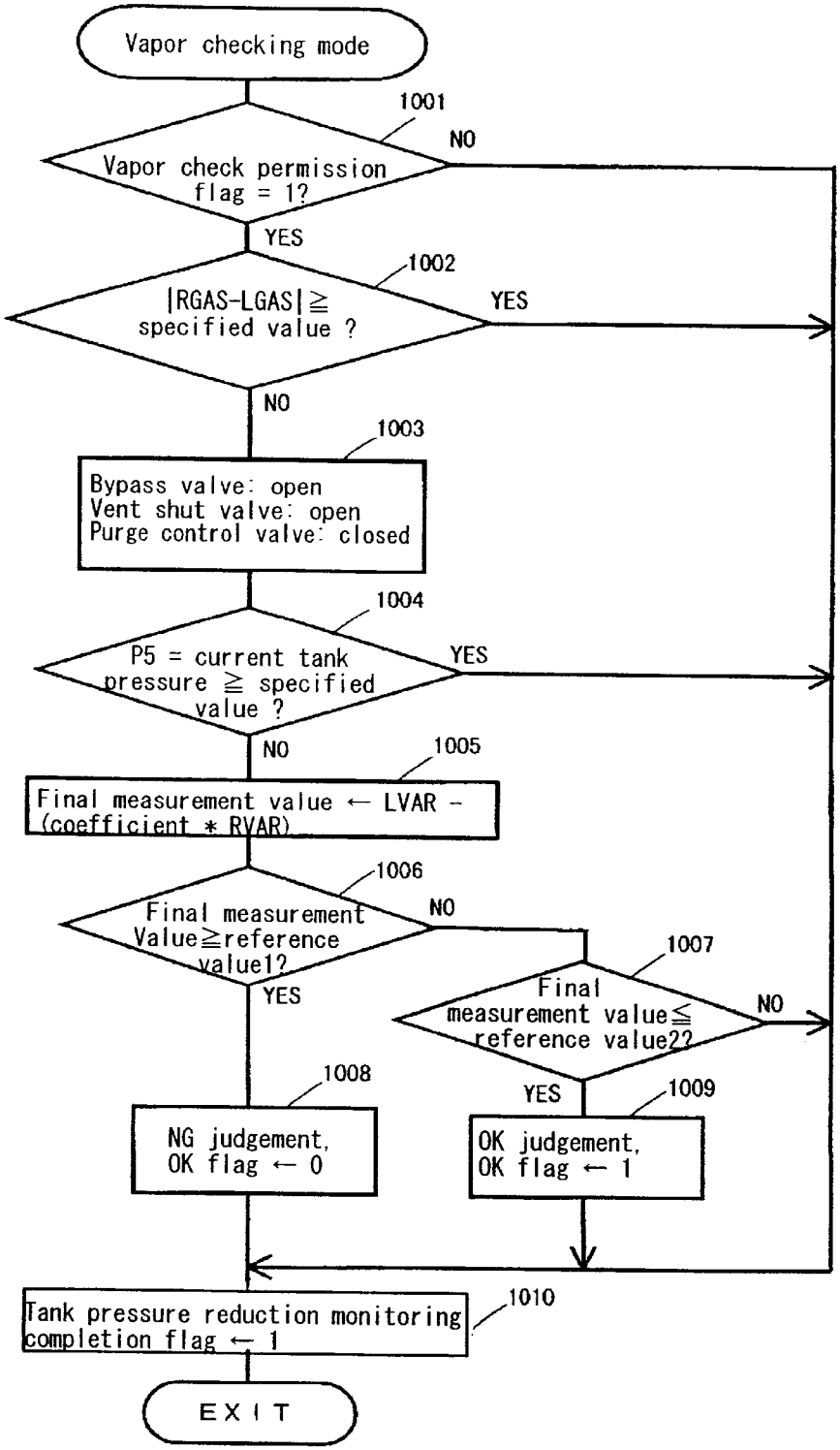
FIG. 11 is a flow chart illustrating the processing in the vapor checking mode.

FIG. 11 is a flow chart which shows the judgment of the status of the tank pressure upon the completion of the tank leak checking mode, and the judgment of the presence or absence of leakage in the tank system, in the vapor checking mode. This processing is performed by the vapor checking part 66 shown in FIG. 2, the judgment execution checking part 73 contained in said vapor checking part 66, the pressure variation checking part 74, the judgment prohibition part 75 and the judgment part 76. If the vapor check permission flag which is set upon the completion of the tank leak check processing is 1 in step 1001, the processing proceeds to step 1002, and the vapor checking process is initiated.

In step 1002, a judgment is made as to whether or not the absolute value of the difference between the correction check fuel consumption amount RGAS and the tank leak check fuel consumption amount LGAS is equal to or greater than a predetermined value. If the absolute value of this difference is equal to or greater than this predetermined value, then it is judged that an accurate judgment cannot be made, since the operating states for the two modes differ greatly. Accordingly, the processing proceeds to step 1010, the tank pressure reduction monitoring completion flag is set at 1, and tank pressure reduction monitoring for this operating cycle is prohibited. As a result, no judgment of the presence or absence of leakage in the tank system is performed. In regard to the above-mentioned predetermined value, data indicating the effects of different operating states in the correction checking mode and leak checking mode on the detection of leakage caused by very small holes is accumulated by experiment and simulation, and the above-mentioned predetermined value is determined on the basis of the results obtained.

In step 1002, if the absolute value of the difference between RGAS and LGAS is smaller than the value determined as described above, the processing proceeds to step 1003; here, the bypass valve 24 and vent shut valve 26 are opened, and the purge control valve is closed, so that the tank system is opened to atmospheric pressure. The processing then proceeds to step 1004; here, the current tank pressure and the tank pressure P5 measured upon the completion of the tank leak check, which was stored in step 911 of the tank leak check (FIG. 10), are compared, and a judgment is made as to whether or not the tank pressure has dropped toward atmospheric pressure from a positive pressure. In other words, a judgment is made as to whether or not the tank pressure was a positive pressure.

If the tank pressure has dropped from a positive pressure toward atmospheric pressure, this indicates that large amounts of vapor were generated so that the tank pressure fluctuated to a positive pressure at the time of completion of the tank leak checking mode, thus making it impossible to make an accurate judgment. Accordingly, the processing proceeds to step 1010, the tank pressure reduction monitoring completion flag is set at 1, and monitoring is thus prohibited so that no judgment of the projection optical system of leakage in the tank system is made. If the tank pressure has not dropped from a positive pressure to atmospheric pressure by an amount equal to or greater than the above-mentioned predetermined value, the processing proceeds to step 1005, and the final measurement value used to make a judgment is calculated using the following equation:

$$\text{Final measurement value} = LVAR - (\text{correction coefficient} \times RVAR) \quad \text{(Formula 4)}$$

Here, LVAR is the amount of pressure shift per unit time during the tank leak check obtained in step 910 (FIG. 10), and RVAR is the amount of pressure shift per unit time during the correction check obtained in step 807 (FIG. 9). The correction coefficient is a coefficient used to correct for different conditions for the pressure rise from atmospheric pressure in the correction checking mode and for the pressure rise from a negative pressure in the tank leak checking mode. For example, this coefficient is 1.5 to 2.0.

The processing proceeds to step 1006. If the calculated final measurement value is equal to or greater than reference value 1 (e.g., 8 mmHg), it would appear that the pressure rise in the tank leak checking mode is caused by leakage in the tank system. Accordingly, the processing proceeds to step 1008, and a judgment of "abnormal" with leakage in the tank system is made. Consequently, the OK flag is set at "0". If the calculated final measurement value is smaller than reference value 1, the processing proceeds to step 1007. In step 1007, if the calculated final measurement value is equal to or less than reference value 2 (e.g., 3 mmHg), it would appear that the pressure rise in the tank leak checking mode is caused by the generation of vapor. Accordingly, the processing proceeds to step 1009, and a judgment of "normal" with no tank leakage is made. Consequently, the OK flag is set at "1".

In step 1007, if the final measurement value is larger than reference value 2, i.e., if the final measurement value is larger than reference value 2 but smaller than reference value 1, [this means that] the presence or absence of leakage cannot be accurately judged. Accordingly, the processing proceeds to step 1010, the tank pressure reduction monitoring completion flag is set at 1, and tank pressure reduction monitoring is prohibited. These relationships are shown in the table below.

TABLE 1

| | |
|---|---|
| Final measurement value ≧ reference value 1 | NG |
| Final measurement value ≦ reference value 2 | OK |
| Reference value 2 < final measurement value < reference value 1 | No judgment made |

Thus it has been shown that the present invention makes it possible to improve the reliability of judgments of the presence or absence of leakage in the tank system.

Although the invention has been shown and described with reference to specific embodiments, it is understood that these embodiments are given only as examples and that any modifications and changes are possible, provided they do not depart from the scope of the patent claims.

What is claimed is:

1. An evaporated fuel treatment apparatus for an internal combustion engine having a fuel tank, a canister having an opening to the atmosphere, a passage allowing the fuel tank to communicate with the canister, a purging passage allowing the canister to communicate with the intake manifold of the engine, the intake manifold having a reduced pressure as the engine intakes air, and a pressure sensor for detecting the internal pressure of the fuel tank, said apparatus comprising:

a controller coupled to the pressure sensor and configured to control opening of the fuel tank alternately to the atmosphere and to a negative pressure, said controller detecting the presence or absence of leakage on the basis of the change in negative pressure that occurs after the fuel tank has been placed under a negative pressure, wherein said controller prohibits the detection of the presence or absence of the leakage in response to a change in the internal pressure of the fuel tank in the direction of negative pressure when the fuel tank is not opened to the atmosphere.

2. The apparatus of claim 1, further comprising a bypass valve that is configured to open the fuel tank to atmospheric pressure when in an opened state and to isolate the fuel tank from atmospheric pressure when the fuel tank is in a closed state.

3. The apparatus of claim 2, further comprising a vent shut valve located between the bypass valve and the atmosphere and configured to open to the atmosphere when in an opened state and to close to the atmosphere when in a closed state.

4. The apparatus of claim 3, wherein the controller is configured to control operation of the bypass valve and the vent shut valve.

5. The apparatus of claim 4, further comprising a purging valve in the purging passage between the canister and the intake manifold and configured to open the purging passage when in an opened state and to close the purging passage when in a closed state.

6. The apparatus of claim 5 wherein the controller is configured to control operation of the purging valve.

7. A method of detecting fuel vapor leaks in a fuel tank system, comprising:

monitoring the pressure of fuel vapors in the fuel tank system to determine the presence or absence of leakage on the basis of a change in negative pressure that occurs in the fuel tank;

placing the fuel tank under a negative pressure; and prohibiting the detection of the presence or absence of leakage in response to a change in the internal pressure of the fuel tank in the direction of a negative pressure when the fuel tank is not opened to the atmosphere.

8. The method of claim 7, further comprising controlling a bypass valve that opens the fuel tank to the atmosphere to close so that the fuel tank is not opened to the atmosphere and to enable a negative pressure to occur in the fuel tank.

9. The method of claim 7 wherein prohibiting the detection of the presence or absence of the leakage further comprises comparing the pressure in the fuel tank to a predetermined value and determining if the internal pressure of the fuel tank has changed in the direction of a negative pressure.

10. The method of claim 9 wherein detecting the presence or absence of leakage comprises monitoring the pressure of fuel vapors in the fuel tank for fuel vapor leaks of a predetermined size.

11. The method of claim 10 wherein detecting the presence or absence of leakage further comprises determining whether or not there has been an abrupt change in the fuel vapor pressure in the fuel tank to determine when there has been an abrupt change in the fuel vapor pressure in the fuel tank.

12. The method claim 11 wherein detecting the presence or absence of leakage further comprises determining if the amount of fuel consumption in the engine is equal to or greater than a predetermined value and, where the amount of fuel consumption is equal to or greater than the predetermined value, a determination is made as to whether or not the maximum value of tank pressure is greater than a predetermined value.

13. A system for determining vapor leaks in a liquid tank, the system comprising:

a sensor for detecting vapor pressure in the liquid tank and for generating a pressure signal; and a processor coupled to the sensor and configured to receive the pressure signal and to detect a leak condition in the liquid tank, the processor further configured to prohibit the detection of a leak condition in the liquid tank after the liquid tank has been placed under a negative pressure when the vapor pressure in the liquid tank changes in a negative direction when the liquid tank is not opened to atmospheric pressure.

14. The system of claim 13, further comprising a bypass valve configured to expose the fuel tank to atmospheric pressure, the bypass valve coupled to the processor for controlling operation of the bypass valve such that the bypass valve is in a closed configuration when the processor prohibits the detection of a leak condition.

15. The system of claim 13, further comprising a vent shut valve and a bypass valve located between the fuel tank and the atmosphere, the vent shut valve and the bypass valve coupled to the processor, and wherein the processor is configured to control the vent shut valve and the bypass valve such that the vent shut valve and the bypass valve are in a closed state such that the fuel tank is not exposed to atmospheric pressure when the controller prohibits the detection of a leak condition in the liquid tank.

* * * * *